US005210426A

United States Patent [19]

Itoh et al.

[11] Patent Number: 5,210,426

[45] Date of Patent: May 11, 1993

[54] ELECTRON BEAM IRRADIATION DEVICE AND METHOD OF MANUFACTURING AN ELECTRON BEAM PERMEABLE WINDOW

[75] Inventors: Yoshiyasu Itoh; Yutaka Ishiwata; Masataka Tamura, all of Kanagawa, Japan

[73] Assignee: Kabushiki Kaisha Toshiba, Kawasaki, Japan

[21] Appl. No.: 774,970

[22] Filed: Oct. 15, 1991

[30] Foreign Application Priority Data

Oct. 12, 1990 [JP] Japan ..... 2-273774
Aug. 12, 1991 [JP] Japan ..... 3-202023

[51] Int. Cl.[5] ..... H01J 33/04

[52] U.S. Cl. ..... 250/492.3; 250/503.1; 313/420; 219/121.21

[58] Field of Search ..... 250/492.3, 492.1, 503.1; 313/420; 219/121.12, 121.13, 121.14, 121.21; 427/250, 376.4, 376.8

[56] References Cited

U.S. PATENT DOCUMENTS

| | | | |
|---|---|---|---|
| 4,324,980 | 4/1982 | Symmons | 313/420 |
| 4,362,965 | 12/1982 | Kendall | 313/420 |
| 4,446,373 | 5/1984 | Denholm et al. | 250/492.2 |
| 4,591,756 | 5/1986 | Avnery | 250/503.1 |
| 4,642,467 | 2/1987 | Yamawaki et al. | 250/492.3 |

FOREIGN PATENT DOCUMENTS

| | | |
|---|---|---|
| 0253294 | 1/1988 | European Pat. Off. . |
| 62-077871 | 9/1987 | Japan . |
| 2-184292 | 7/1990 | Japan . |
| 3-089867 | 7/1991 | Japan . |

OTHER PUBLICATIONS

Kazuo Kasahara et al, "Oxidation Behavior of Intermetallic Compounds TiAl at High Temperatures", *J. Japan Inst. Metals*, vol. 53, No. 1 (1989). pp. 58–62.

Keita Kawamura et al., "Treatment of Exhaust Gases by Electron Beam Irradiation", vol. 20, No. 5 (1978).

*Primary Examiner*—Jack I. Berman
*Assistant Examiner*—Kiet T. Nguyen
*Attorney, Agent, or Firm*—Foley & Lardner

[57] ABSTRACT

This invention provides an electron beam irradiation device employing a material containing a Ti-A1 intermetallic composite as the material of an electron beam permeable window for allowing passage to the outside of a chamber of an electron beam generated in the chamber. Also, this invention provides a method of manufacturing an electron beam permeable window containing a Ti-A1 intermetallic composite by manufacturing a window-frame mounted titanium foil by fixing titanium foil between an outer window frame and an inner window frame of an electron beam permeable window, coating this with aluminium and titanium by converting aluminium and titanium to a metallic vapor state and subjecting this to thermal diffusion treatment.

6 Claims, 8 Drawing Sheets

ELECTRON BEAM IRRADIATION DEVICE AND METHOD OF MANUFACTURING AN ELECTRON BEAM PERMEABLE WINDOW

BACKGROUND OF THE INVENTION

This invention relates to an electron beam irradiation device for carrying out welding or heat treatment. In particular it relates to an electron beam irradiation device constituted by partitioning, by an electron beam permeable window, the interior and exterior of a chamber for electron beam generation, which is maintained in a vacuum condition, and a method of manufacturing an electron beam permeable window.

Electron beam irradiation devices are employed, for example, in fixed recovery systems for NOx or SOx by induced chemical reaction of waste gases, or to effect the bridging of high molecular compounds.

In conventional electron beam irradiation devices, irradiation of a workpiece that is to be subjected to heat treatment is performed by inserting it into a chamber. Due to the need to prolong filament life etc, this chamber had to be maintained at a degree of vacuum of about $10^{-4}$ to $10^{-5}$ torr. The size of the workpiece is restricted since the chamber therefore could not be made very large.

However, by using an electron beam permeable window to partition the interior and exterior of the chamber, it has become possible to lead the electron beam out to the exterior through the electron beam permeable window so that electron beam irradiation could be effected in the atmosphere or a specified gas.

Titanium foil was conventionally employed as the material of this window for leading out the electron beam. Titanium is employed on account of its excellent electron permeability, high melting point, and the fact that it can be manufactured in thin foil a few tens of microns in thickness.

In order to confirm these characteristics of titanium, the inventors investigated the electron permeability, melting point, thermal conductivity and electrical resistance etc. of titanium in comparison with various other materials. The results of this investigation are shown in Table 1. In Table 1, $M/(\rho \cdot Z^{8/9})$ is a coefficient found from the maximum depth which the electron beam penetrates into the interior of a workpiece when the workpiece is irradiated by the electron beam, and expresses the transmittance of the electron beam. It is desirable that this transmittance of the material of the window should be as high as possible. And from the point of view of heat resistance, the melting point should also be as high as possible.

| | M | P | Z | $\frac{M}{\rho \cdot Z^{8/9}}$ | (°C.) | (cal/9° C.) | (cal/cm-S-t) | ($\times 10^{-6}\Omega$-m) |
|---|---|---|---|---|---|---|---|---|
| K | 19 | 0.86 | 39.1 | 0.849 | 760 | 0.177 | 0.74 | 6.15 |
| Ca | 20 | 1.55 | 40.1 | 0.485 | 838 | 0.149 | 0.3 | 3.91 |
| Mg | 12 | 1.74 | 24.3 | 0.405 | 650 | 0.245 | 0.367 | 4.45 |
| P | 15 | 1.83 | 30.97 | 0.388 | 44.25 | 0.177 | — | $1 \times 10^7$ |
| Si | 14 | 2.33 | 28.08 | 0.310 | 1410 | 0.162 | 0.20 | 10 |
| Be | 4 | 1.848 | 9.012 | 0.307 | 1277 | 0.45 | 0.35 | 4 |
| C | 6 | 2.25 | 12.01 | 0.293 | 3727 | 0.165 | 0.057 | 1375 |
| Al | 13 | 2.7 | 26.98 | 0.257 | 660 | 0.215 | 0.53 | 2.65 |
| Ti | 22 | 4.507 | 47.9 | 0.157 | 1668 | 0.124 | 0.053 | 42 |
| Ge | 32 | 5.32 | 72.6 | 0.133 | 937 | 0.073 | 0.14 | 46 |
| V | 23 | 6.1 | 50.9 | 0.115 | 1900 | 0.119 | 0.074 | 25 |
| Zr | 40 | 6.49 | 91.22 | 0.112 | 1852 | 0.067 | 0.211 | 40 |
| Fe | 26 | 7.87 | 55.8 | 0.0926 | 1536 | 0.11 | 0.18 | 9.71 |
| Cu | 27 | 8.96 | 63.55 | 0.0808 | 1083 | 0.092 | 0.941 | 1.67 |

Furthermore, to lower heat emission, preferably the thermal conductivity should be high and the electrical resistance low. However, it may not be possible for a material to have both high electrical resistance and yet low thermal conductivity.

There are several materials that have better electron permeability than titanium. However, of these, potassium, calcium, magnesium, phosphorus and aluminium all have low melting points and so cannot be expected to be capable of standing up to the heat generated by the passage of the electron beam. Beryllium is toxic, carbon has very poor resistance to oxidation, and silicon is difficult to produce in the form of a thin film and is mechanically brittle. Because of this, the presently used titanium foil, while not necessarily representing the perfect solution, may be considered as being a comparatively satisfactory material.

However, notwithstanding that titanium foil has excellent electron permeability etc., due to its tendency to creep when heated by the thermions generated during passage of the electron beam, it undergoes severe corrosion damage by reaction with the atmosphere or special gas atmospheres outside the chamber. Also, titanium foil tends to be deformed or damaged by the difference in the internal and external pressure of the chamber. These reasons make prolonged use of an electron beam irradiation device at high output difficult.

In an electron beam irradiation device, cooling of the window is therefore carried out by providing the window with a cooling mechanism. However, there is the problem that the energy loss in performing cooling is considerable. That is, when titanium foil is heated by electron beam irradiation over a long period, parts which are in contact with the atmosphere or corrosive gases of a gas atmosphere are damaged and reduced in thickness. When such thinned titanium foil is heated to high temperature, creep is produced by the difference in internal and external pressures at the window. This may result in breakage of the titanium foil due to creep damage, with the risk of the atmosphere or gases entering the chamber, damaging the electron beam generating device.

SUMMARY OF THE INVENTION

An object of this invention is to provide an electron beam irradiation device having an electron beam permeable window wherein oxidation resistance and creep resistance can be improved without impairing the electron beam permeability.

A further object of this invention is to provide a method of manufacturing an electron beam permeable window having such properties.

The objects of this invention described above are achieved by the means and steps described below.

An electron beam irradiation device according to this invention for welding or heat treatment by irradiating a workpiece arranged outside of a chamber, whose interior is maintained in vacuum condition, with thermions generated inside the chamber, which permeate to outside the chamber, comprises the following: electron generating means for generating thermions provided in the chamber; electron accelerating means for accelerating the thermions provided in the chamber; electron controlling means for controlling the direction in which the thermions are projected, provided in the chamber; and an electron beam permeable window, constituted of a material containing a Ti-A1 intermetallic compound, for allowing passage of the thermions in the chamber to outside the chamber.

A method according to this invention of manufacturing an electron beam permeable window for allowing passage of thermions generated inside a chamber maintained under vacuum conditions to outside this chamber, comprises the following steps: a step of manufacturing a titanium foil, mounted on a window frame, by fixing a titanium foil between an outer window frame and an inner window frame of the electron beam permeable window; a step of coating the window-frame mounted titanium foil with aluminium by converting the aluminium to a metallic vapor state; a step of changing the titanium foil to a material containing a TiA1 intermetallic compound by performing thermal diffusion treatment on the window-frame mounted titanium foil that has been coated with aluminium; and a step of finish working the window-frame mounted titanium foil that has been subjected to thermal diffusion treatment.

A further method according to this invention of manufacturing an electron beam permeable window for allowing passage of thermions generated inside a chamber maintained under vacuum conditions to outside this chamber, comprises the following steps: a step of manufacturing a titanium foil, mounted on a window frame, by fixing a titanium foil between an outer window frame and an inner window frame of the electron beam permeable window; a step of coating the window-frame mounted titanium foil with a TiA1 intermetallic compound by converting titanium and aluminium to a metallic vapor state; a step of performing thermal diffusion treatment on the window-frame mounted titanium foil that has been coated with the Ti-A1 intermetallic compound; and a step of finish working the window-frame mounted titanium foil that has been subjected to thermal diffusion treatment.

DETAILED DESCRIPTION OF THE PREFERRED EMBODIMENTS

Figure 1:
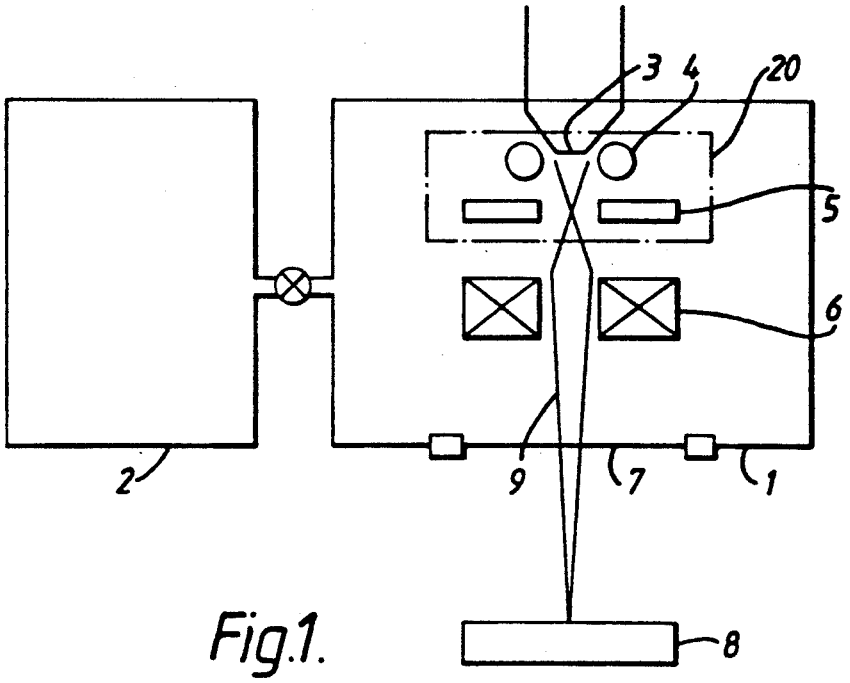
FIG. 1 is a diagram of an embodiment of an electron beam irradiation device according to this invention.

FIG. 1 shows an embodiment of an electron beam irradiation device according to this invention.

The interior of a chamber 1 is maintained practically under vacuum conditions by a vacuum pump 2. Thermions are generated in this vacuum by an electron generating means 3. Electron generating means 3 consists of a filament made of metal such as tungsten, that is heated by a D.C. power source. The thermions that are generated by this heating are accelerated by an electron accelerating means 20. This electron accelerating means 20 consists of a cathode 4 and anode 5. The thermions are accelerated by the electric field created by high voltage that is applied to cathode 4 and anode 5.

The thermions are controlled by the magnetic field of an electron control means 6 consisting of a deflecting coil and are directed onto a workpiece 8 after passing through an electron beam permeable window 7. The kinetic energy of this irradiated electron beam 9 is converted into heat energy in workpiece 8, to perform welding or heat treatment of workpiece 9.

A ti-A1 intermetallic compound or a titanium foil coated with a TiA1 intermetallic compound is employed as the material of window 7.

Such an electron beam 9 provides an excellent heat source in that it has a much higher energy efficiency than for example a laser, and the beam can easily be controlled electrically. For this reason, wide application of electron beam irradiation devices as industrial working devices is being considered.

Electron beam permeable window 7 employed in an electron beam irradiation device according to this invention is manufactured as follows.

Figure 2:
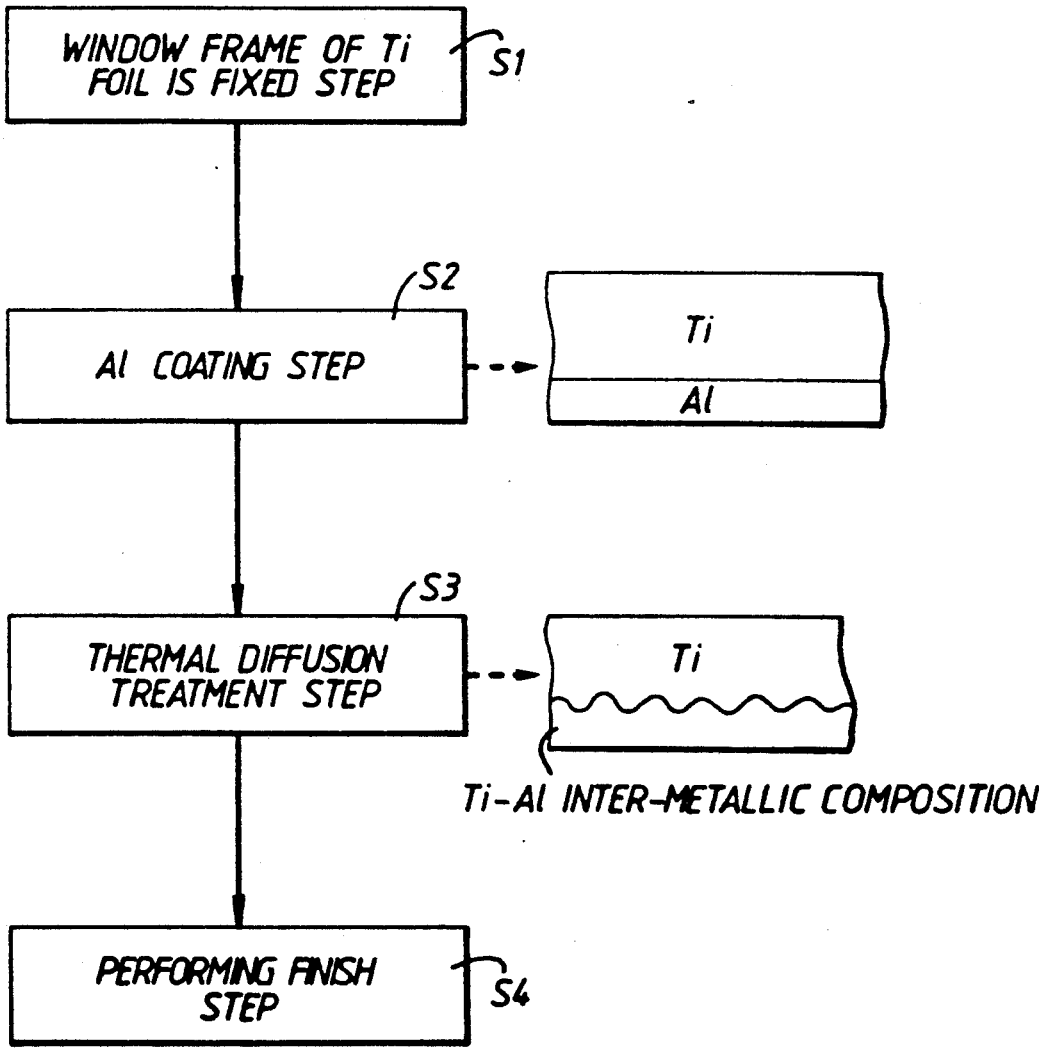
FIG. 2 is a flow chart showing an embodiment of a method of manufacturing an electron beam permeable window according to this invention.

FIG. 2 is a flow chart showing an embodiment of the process of manufacturing an electron beam permeable window 7. First, the window frame of the titanium foil is fixed (S1). Secondly, the aluminium coating is done (S2). The third step is thermal diffusion (S3), and the last step (S4) consists of performing finish working.

Figure 3:
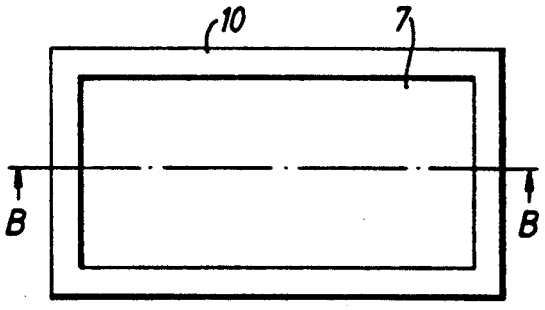
FIG. 3 is a bottom view of an electron beam permeable window.
Figure 4:
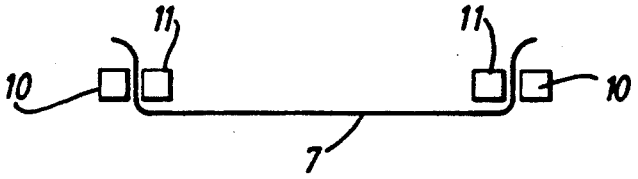
FIG. 4 is a cross-section along the line B—B of FIG. 3.

FIG. 3 is a bottom view of electron permeable window 7. FIG. 4 is a cross-sectional view along the line B—B in FIG. 3. As shown in FIG. 4, the titanium foil is fixed between an outside window frame 10 and inside window frame 11, thereby constituting a window frame mounted titanium foil. In this case, the material of electron beam permeable window 7 is titanium foil. This is arranged such that sagging of the titanium foil is not produced, so that it can exhibit full performance. The material of outside window frame 10 and inside window frame 11 is Ti-6Al-4V alloy. This has a linear expansion coefficient that is matched to that of the titanium foil.

This prevents sagging of the titanium foil which would be produced by thermal history i.e. heating and cooling in subsequent aluminium thermal diffusion treatment step (S3) if there were a difference in the coefficients of linear expansion between the material of outside window frame 10 and inside window frame 11 and the titanium foil which is the material of electron beam permeable window 7.

In more detail, if the coefficient of linear expansion of the material of outside window frame 10 and inside window frame 11 is smaller than that of the titanium foil which is the material of electron beam permeable window 7, after the subsequent aluminium thermal diffusion treatment step (S3), sagging would be produced in electron beam permeable window 7, whereas if the coefficient of linear expansion of the material of outside window frame 10 and inside window frame 11 is greater than that of the titanium foil which is the material of electron beam permeable window 7, after the subsequent aluminium thermal diffusion treatment step (S3), tensile stress would be left behind as residual stress in the titanium foil of electron beam permeable window 7, causing breakage of this titanium foil. This is prevented by making the coefficients of linear expansion equal.

Figure 5:
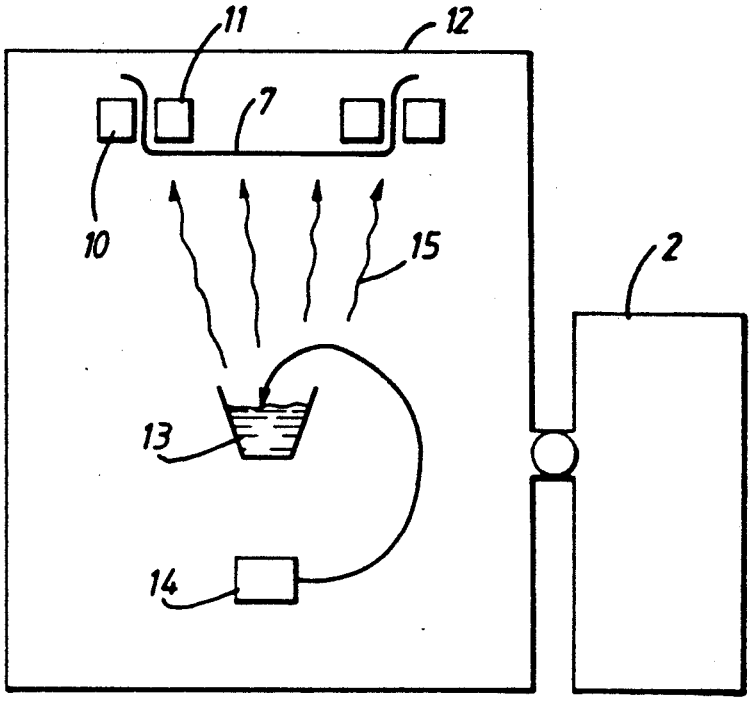
FIG. 5 is a diagram of an aluminium coating step in the embodiment of FIG. 3.

Next, an aluminium coating is produced (S2) on the titanium foil which is fixed between outside window frame 10 and inside window frame as described above. In this aluminium coating step (S2), as shown in FIG. 5, the titanium foil fixed in window frames 10 and 11 is inserted into the top part of an aluminium coating chamber 12 and fixed in position.

Figure 12:
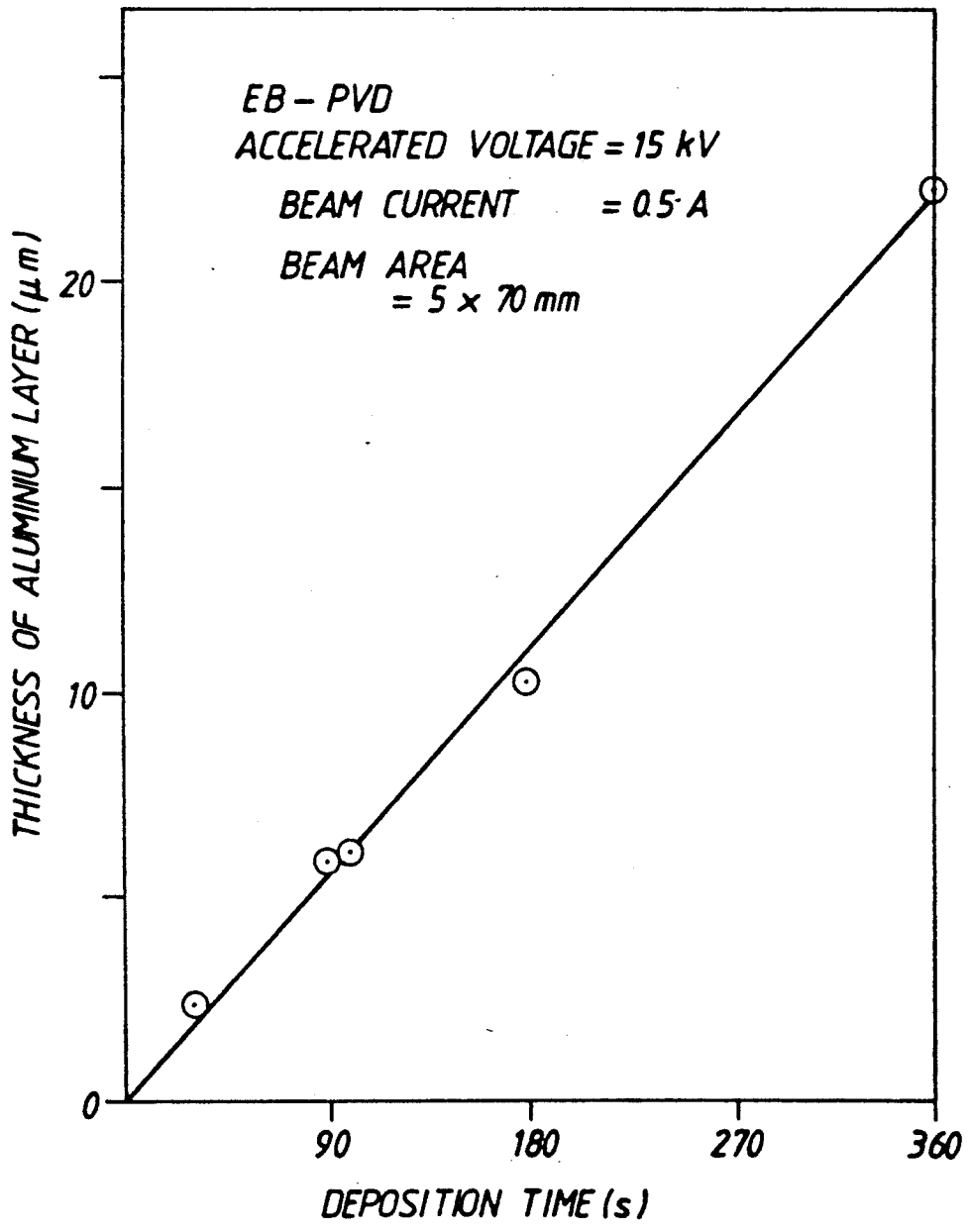
FIG. 12 is a graph showing the thickness of the deposition layer as a function of deposition time.

Coating chamber 12 is then evacuated. Next, aluminium is evaporated by using an electron gun 14 to heat a crucible 13 containing aluminium. The aluminium is heated to above 2000° C. using the electron gun which has an accelerator voltage of 15kv, beam current of 0.5A and a beam area of 5×70 mm. Aluminium coating is thereby performed by depositing this aluminium in the form of a metal vapor onto the surface of the titanium foil. The thickness of the deposition is mainly controlled by the deposition time as shown in FIG. 12.

Figure 6:
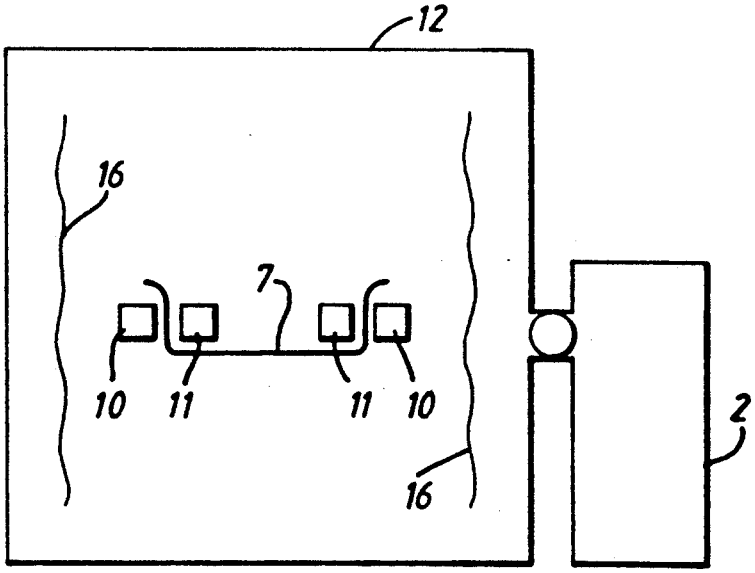
FIG. 6 is a diagram of a thermal diffusion treatment step in the embodiment of FIG. 3.

Thermal diffusion treatment is then performed on this titanium foil that has been coated with aluminium. As shown in FIG. 6, heat is applied by means of a heater 16 arranged at the periphery of this titanium foil fixed in window frames 10 and 11 in coating chamber 12. Thermal diffusion treatment is then performed at 500° C. to 800° C. The Ti-Al intermetallic compound films which are successively obtained as the temperature of this thermal diffusion treatment is increased are respectively: a film of $TiAl_3$ alone, a two-layer film of $TiAl_3$+TiAl, and a three-layer film of $TiAl_3$+TiAl+$Ti_3Al$. This has been verified by the inventors by X-ray diffraction analysis.

When thermal diffusion treatment step (S3) has been completed, the manufacture of electron beam permeable window 7 is completed by performing finish working (S4) of electron beam permeable window 7.

Of the Ti-Al intermetallic composites, the one which has the best oxidation resistance is $TiAl_3$. Whatever the temperature of the thermal diffusion treatment in aluminium coating, $TiAl_3$ is formed as the outermost layer, so there is no particular problem regarding oxidation resistance.

All Ti-Al intermetallic compounds have poor ductility, so in the case of thick films formed by thermal diffusion treatment at high temperature, there is a possibility that the film strength will be lowered. The inventors therefore carried out a comparative study of the properties of an electron beam permeable window 7 with a $TiAl_3$ film formed on the titanium surface by thermal diffusion treatment at comparatively low temperature with a conventional electron beam permeable window 7 made of untreated titanium foil.

The evaluation of properties in this experiment was performed for two examples. One example was a conventional electron beam permeable window 7 of thickness 20 μm made of titanium foil. The other example was an electron beam permeable window 7 of thickness 20 μm made of titanium foil on the surface of which a 2 μm thick layer of $TiAl_3$ had been formed, according to this invention. The results obtained are shown in FIG. 7 and FIG. 8.

Figure 7:
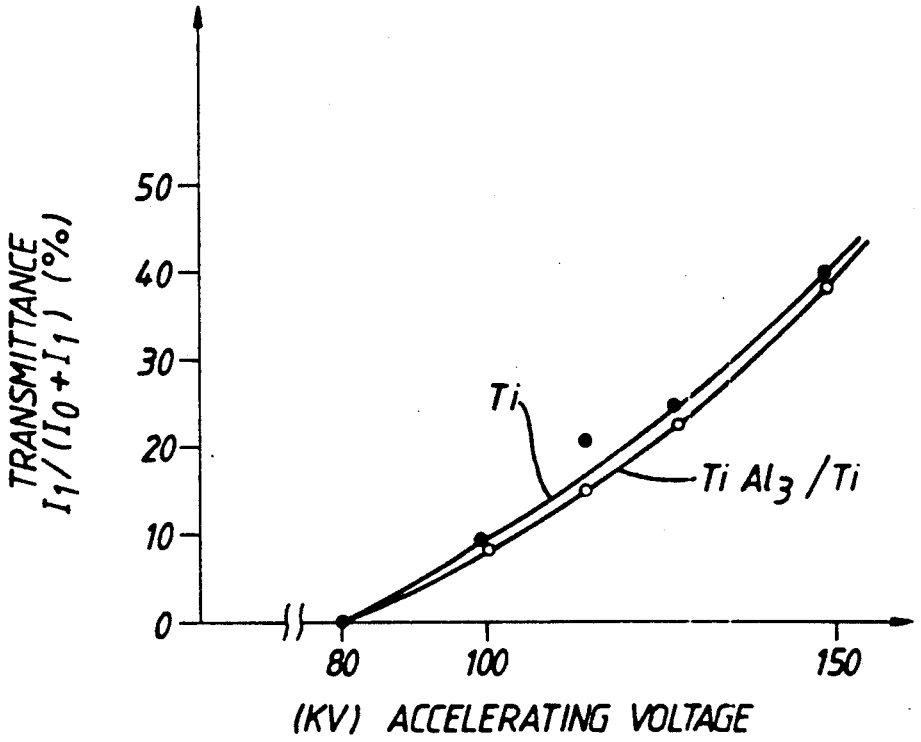
FIG. 7 is a graph of the transmittance characteristic of an electron beam passing through an electron beam permeable window.

FIG. 7 is a plot of the characteristic of the accelerating voltage of an electron beam passing through electron beam permeable window 7 against the transmittance of the electron beam. The electron beam transmittance was evaluated by measuring the current $I_0$ trapped by electron beam permeable window and the current $I_1$ passing through electron beam permeable window 7. As shown in FIG. 7, the electron beam transmittance of both the untreated titanium foil and the $TiAl_3$/Ti foil wherein a layer $TiAl_3$ was formed on the surface of titanium foil increased as the accelerating voltage was increased. In fact, it can be seen that the transmittance of these two was practically the same, with no significant difference.

Figure 8:
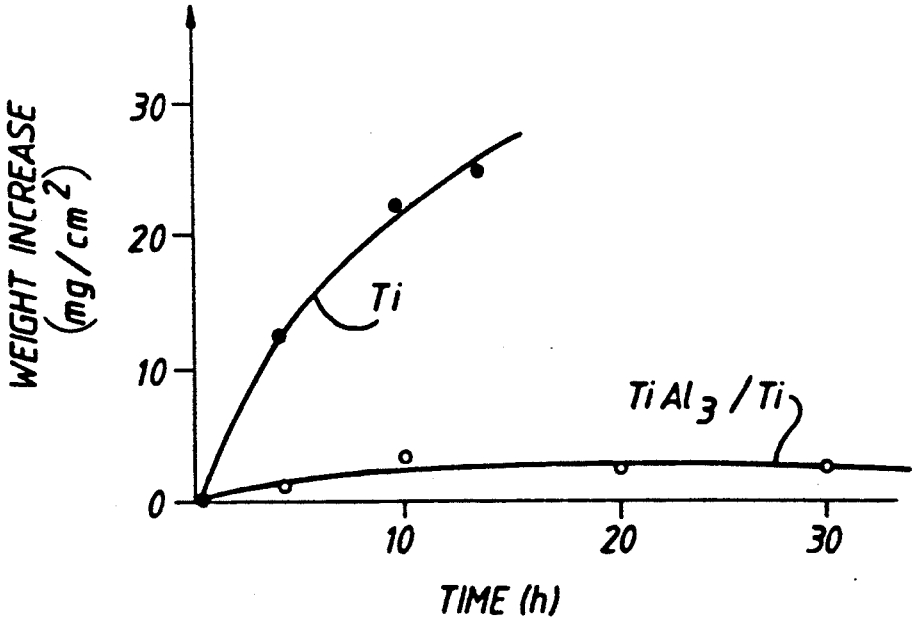
FIG. 8 is a graph showing the oxidation resistance characteristic of the material of an electron beam permeable window.

FIG. 8 is a plot showing the oxidation resistance characteristic. In this Figure, the vertical axis represents the weight increase, which indicates the degree of oxidation, whilst the horizontal axis represents the time of use of the electron beam. Oxidation resistance was compared by heating untreated titanium foil and $TiAl_3$/Ti foil formed by producing a layer of $TiAl_3$ on both sides of titanium foil to 800° C. in the atmosphere and then measuring the change in weight.

As is clear from FIG. 8, the performance of the $TiAl_3$/Ti foil was improved by a factor of 10 or more over that of untreated titanium foil.

Also, the oxidation life characteristics of the material of electron beam permeable window 7 were compared by arranging an electron beam permeable window 7 made of untreated titanium foil and an electron beam permeable window 7 made of $TiAl_3$/Ti foil separately in electron beam irradiation devices and performing continuous operation with 100 kW output. In this way, it was found that forming $TiAl_3$ on the surface of the titanium foil prolonged its life by about 5 to 10 times.

The resistance of creep of the material of electron beam permeable window 7 was also compared by measuring the amount of change of sagging of electron beam permeable window 7 on carrying out an experiment as above, but with a pressure of 2.5 atmospheres acting on the material of electron beam permeable window 7. As a result, it was found that the creep resistance characteristic of the $TiAl_3$/Ti foil showed an improvement of about 1.5 to 2.0 times in comparison with the untreated titanium foil.

Thus, with this embodiment, a workpiece can be irradiated by an electron beam in the same way as conventionally, but the oxidation resistance of the permeable window i.e. its corrosion resistance and creep resistance characteristic can be improved without impairing the electron beam permeability. Furthermore, by these improvements, the life of the window material can be greatly extended.

Figure 9:
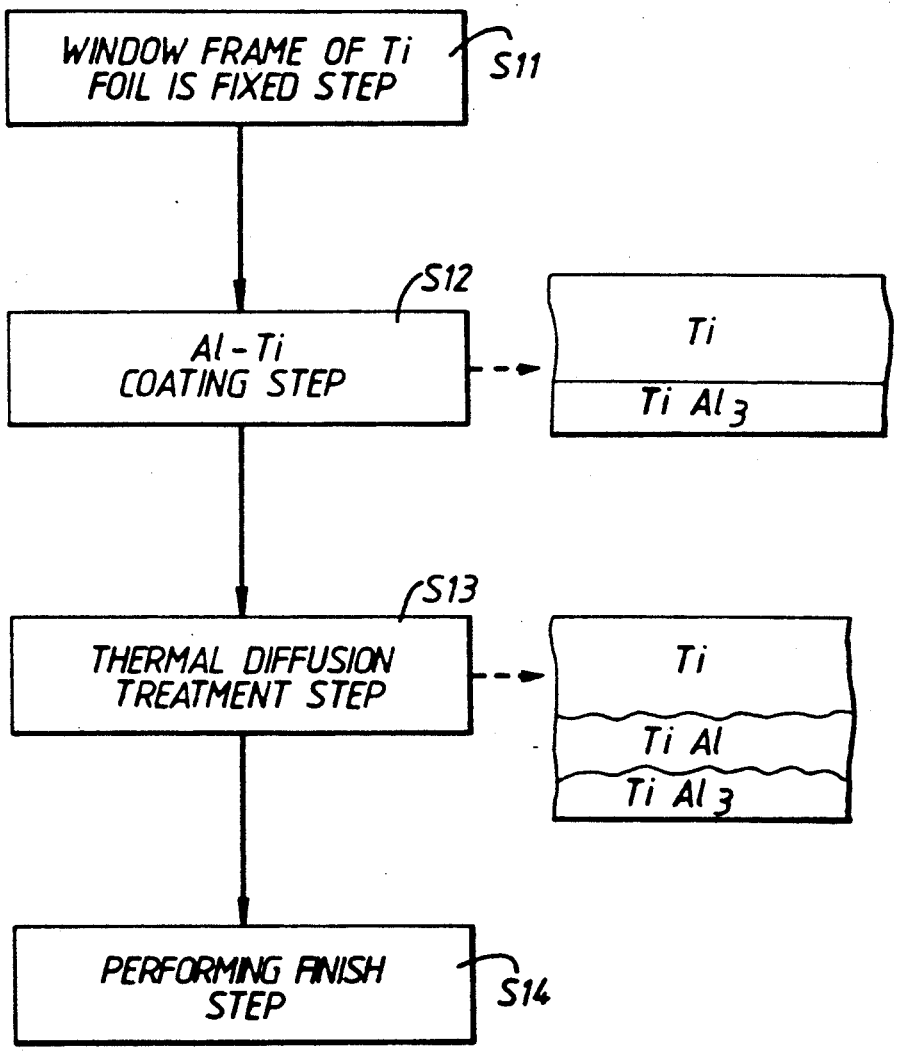
FIG. 9 is a flow chart showing a further embodiment of a method of manufacturing an electron beam permeable window according to this invention.

Next, a further embodiment of the process of manufacturing an electron beam permeable window 7 is shown in FIG. 9. In the same way as in the FIG. 2 embodiment, the titanium foil is fixed between outside window frame 10 and inside window frame 11 (S11). This titanium foil is then coated with a $TiAl_3$ intermetallic compound (S12). The third step is thermal diffusion treatment (S13) and the last step (S14) consists of performing finish working.

Figure 10:
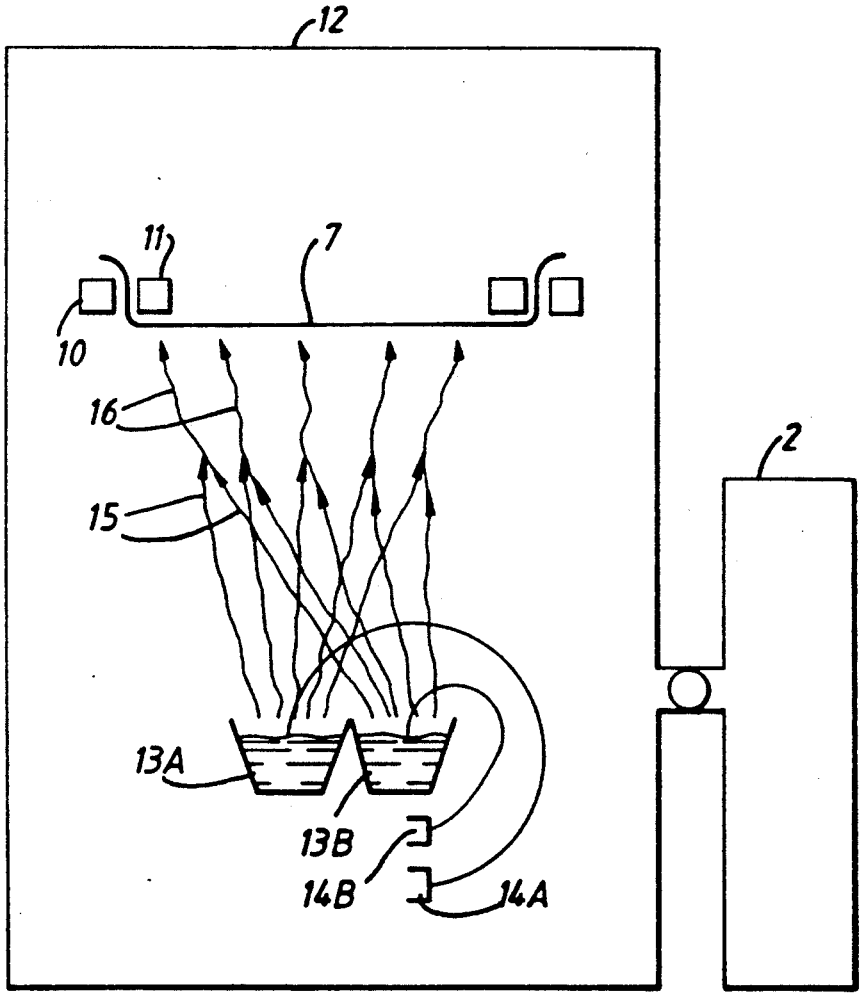
FIG. 10 is a diagram of an embodiment of a Ti-A1 intermetallic compound coating step in FIG. 9.

To produce this $TiAl_3$ inter-metallic compound coating, as shown in FIG. 10, the titanium foil fixed between outside window frame 10 and inside window frame 11 is arranged at the top of a coating chamber 12 while a crucible 13A containing aluminium and a crucible 13B containing titanium are arranged at the bottom of coating chamber 12. Coating chamber 12 is then evacuated to vacuum condition by a vacuum pump 2, and crucible 13A containing aluminium and crucible 13B containing titanium are heated by electron guns 14A and 14B to above 2000° C. Electron guns 14A and 14B utilizes an accelerator voltage of 15kv, a beam current of 0.5A and a beam area of 5×70 mm.

The aluminium and titanium metallic vapors 15 and 16 produced by this heating react in the vacuum in coating chamber 12 to produce a Ti-Al intermetallic composite, which is deposited on the titanium foil. A characteristic of this case is that diffusion treatment is not always necessary.

Thermal diffusion treatment is then performed (S13). The coating layer of Ti-Al intermetallic compound and the titanium foil are thereby made to adhere to each other. Also, any aluminium particles left in an unreacted state are made to react to produce the Ti-Al intermetallic composite.

When the thermal diffusion treatment step (S13) is completed, finish working of electron beam permeable window 7 is performed (S14), thereby completing the process of manufacturing electron beam permeable window 7.

Figure 11:
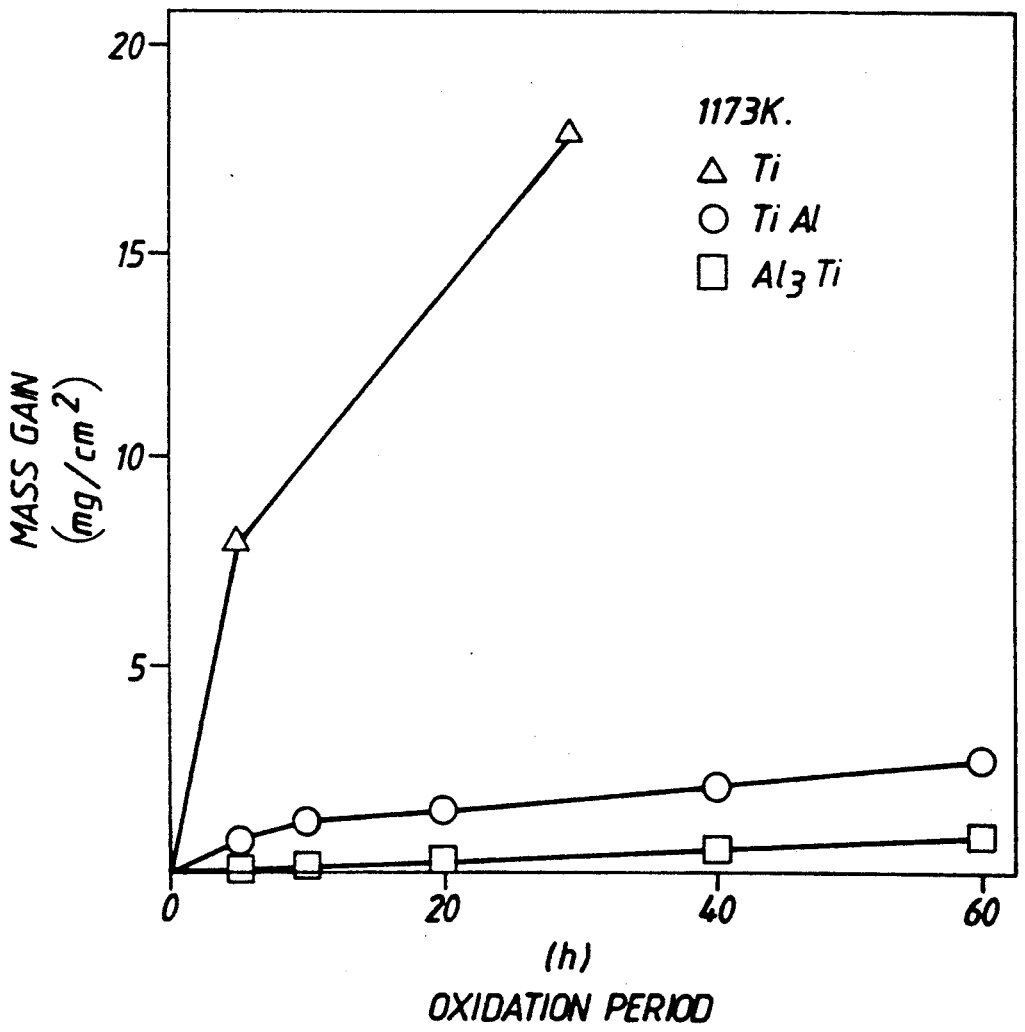
FIG. 11 is a graph showing the oxidation resistance characteristic of the material of an electron beam permeable window.

FIG. 11 is a plot showing the oxidation resistance characteristic. In this Figure, the vertical axis represents the weight increase, which indicates the degree of oxidation, while the horizontal axis represents the time of use of the electron beam. Oxidation resistance was compared by heating untreated titanium foil, $TiAl_3$, foil and TiAl foil to 800° C. in the atmosphere and then measuring the change in weight. As is clear from FIG. 11, the performance of both the TiAl foil and the $TiAl_3$ foil was significantly improved over that of the untreated titanium foil.

In this other embodiment, the $TiAl_3$, TiAl or $Ti_3Al$ films were present only on the surface of the titanium film. However, the invention is not restricted to this, and it would be possible to apply a fairly thick coating of aluminium, after which TiAl or $Ti_3Al$ is formed uniformly through the entire thickness of the window.

Also, the side on which the Ti-Al intermetallic compound film is formed could be only one of the sides of the titanium foil. That is, it could be formed only on the side facing the atmosphere gas in the interior of the chamber, or alternatively it could be formed only on the side facing the air atmosphere outside the chamber. Or it could be formed on both sides.

The Ti-Al intermetallic composite is not restricted to $TiAl_3$, TiAl or $Ti_3Al$ but could be an alloy of each of these.

As described above, with this invention, an electron beam permeable window can be obtained or an electron beam irradiation device that is equipped with such an electron beam permeable window can be provided, displaying the excellent benefits that corrosion resistance and creep resistance are improved without impairing the electron beam permeability, even when used for a long time.

What is claimed is:

1. Method of manufacturing an electron beam permeable window for allowing passage of thermions generated inside a chamber maintained under vacuum conditions to outside this chamber, comprising the following steps:

a step of manufacturing a titanium foil, mounted on a window frame, by fixing a titanium foil between an outer window frame and an inner window frame of said electron beam permeable window; a step of coating said window-frame mounted titanium foil with aluminium by converting the aluminium to a metallic vapor state; a step of changing said titanium foil to a material containing a TiAl intermetallic compound by performing thermal diffusion treatment on said window-frame mounted titanium foil that has been coated with aluminium; and a step of finish working said window-frame mounted titanium foil that has been subjected to thermal diffusion treatment.

2. Method of manufacturing an electron beam permeable window for allowing passage of thermions generated inside a chamber maintained under vacuum conditions to outside this chamber, comprising the following steps:

a step of manufacturing a titanium foil, mounted on a window frame, by fixing a titanium foil between an outer window frame and an inner window frame of said electron beam permeable window; a step of coating said window-frame mounted titanium foil with a Ti-Al intermetallic compound by converting titanium and aluminium to a metallic vapor state; a step of performing thermal diffusion treatment on said windowframe mounted titanium foil that has been coated with said Ti-Al intermetallic compound; and a step of finish working said window-frame mounted titanium foil that has been subjected to thermal diffusion treatment.

3. An electron beam irradiating device for performing welding or heat treatment by irradiating a workpiece arranged outside a chamber, the interior of the chamber being maintained in a vacuum condition, with thermions being generated inside the chamber and which permeate to the outside of the chamber, the device comprising:

electron generating means for generating thermions inside said chamber;

electron accelerating means for generating said thermions inside said chamber;

electron controlling means in said chamber for controlling the direction in which said thermions are projected; and an electron beam permeable window formed of a titanium foil coated with a Ti-Al intermetallic compound, said window allowing passage of said thermions inside of said chamber to the outside of said chamber.

4. An electron beam irradiating device for performing welding or heat treatment by irradiating a workpiece arranged outside a chamber, the interior of the chamber being maintained in a vacuum condition, with thermions being generated inside the chamber and which permeate to the outside of the chamber, the device comprising:

electron generating means for generating thermions inside said chamber;

electron accelerating means for generating said thermions inside said chamber;

electron controlling means in said chamber for controlling the direction in which said thermions are projected; and an electron beam permeable window, the window formed entirely of a Ti-Al intermetallic compound, said window allowing passage of said thermions inside of said chamber to the outside of said chamber.

5. An electron beam irradiating device according to claim 4, wherein the Ti-Al intermetallic compound is $Ti\text{-}Al_3$.

6. An electron beam irradiating device according to claim 4, wherein said Ti-Al intermetallic compound is $Ti\text{-}Al_3$.

* * * * *